US008997941B2

(12) United States Patent
Abad

(10) Patent No.: US 8,997,941 B2
(45) Date of Patent: Apr. 7, 2015

(54) ELEVATOR SAFETY CIRCUIT WITH SAFETY RELAY DELAY

(75) Inventor: Juan Carlos Abad, Shanghai (CN)

(73) Assignee: Inventio AG, Hergiswil (CH)

( * ) Notice: Subject to any disclaimer, the term of this patent is extended or adjusted under 35 U.S.C. 154(b) by 755 days.

(21) Appl. No.: 13/293,618

(22) Filed: Nov. 10, 2011

(65) Prior Publication Data

US 2012/0118675 A1 May 17, 2012

(30) Foreign Application Priority Data

Nov. 11, 2010 (EP) ..... 10190927

(51) Int. Cl.
*B66B 1/34* (2006.01)
*B66B 13/22* (2006.01)
*B66B 1/32* (2006.01)

(52) U.S. Cl.
CPC .. *B66B 13/22* (2013.01); *B66B 1/32* (2013.01)

(58) Field of Classification Search
USPC ..... 187/247, 248, 277, 391–393
See application file for complete search history.

(56) References Cited

U.S. PATENT DOCUMENTS 3,584,706 A 6/1971 Hall et al.
3,599,754 A * 8/1971 Caputo et al. ..... 187/297
3,792,759 A 2/1974 Kirsch
4,304,319 A * 12/1981 Radke ..... 187/284
4,359,208 A 11/1982 Kelm et al.
4,750,591 A * 6/1988 Coste et al. ..... 187/391
4,923,055 A 5/1990 Holland
5,107,964 A * 4/1992 Coste et al. ..... 187/280
5,625,266 A * 4/1997 Stark ..... 318/466
6,446,760 B1 9/2002 Lisi
6,484,125 B1 * 11/2002 Huang et al. ..... 702/183
7,353,916 B2 * 4/2008 Angst ..... 187/393
8,069,958 B2 * 12/2011 Lence-Barreiro ..... 187/393
8,430,212 B2 * 4/2013 Ueda et al. ..... 187/391
2012/0292136 A1 * 11/2012 Washio et al. ..... 187/393

FOREIGN PATENT DOCUMENTS

EP 1864935 A1 12/2007
WO 2009127772 A1 10/2009

* cited by examiner

*Primary Examiner* — Anthony Salata
(74) *Attorney, Agent, or Firm* — Fraser Clemens Martin & Miller LLC; William J. Clemens

(57) ABSTRACT

An elevator safety circuit can be used to decelerate an elevator car during an emergency stop in a controlled manner. The safety circuit includes a series chain of safety contacts having an input connected to a power source and a first safety relay deriving electrical power from an output of the series chain of safety contacts. A delay circuit is arranged between the output of the series chain of safety contacts and the first safety relay. Hence, if any of the safety contacts open to initiate an emergency stop, a process controlled by the operation of the first safety relay is delayed.

16 Claims, 5 Drawing Sheets

ELEVATOR SAFETY CIRCUIT WITH SAFETY RELAY DELAY

CROSS-REFERENCE TO RELATED APPLICATION

This application claims priority to European Patent Application No. 10190927.3, filed Nov. 11, 2010, which is incorporated herein by reference.

FIELD

The disclosure relates to a safety circuit for an elevator.

BACKGROUND

In an elevator installation, an elevator car and a counterweight are conventionally supported on and interconnected by traction means. The traction means is driven through engagement with a motor-driven traction sheave to move the car and counterweight in opposing directions along the elevator hoistway. The drive unit, consisting of the motor, an associated brake and the traction sheave, is normally located in the upper end of the elevator hoistway or alternatively in a machine room directly above the hoistway.

Safety of the elevator is monitored and governed by means of a safety circuit or chain containing numerous contacts or sensors. Such a system is disclosed in U.S. Pat. No. 6,446,760. Should one of the safety contacts open or one of the safety sensors indicate an unsafe condition during normal operation of the elevator, a safety relay within the safety circuit transmits a signal to an elevator control which instructs the drive to perform an emergency stop by immediately de-energizing the motor and applying the brake. The elevator usually cannot be called back into normal operation until the reason for the break in the safety circuit has been investigated and the relevant safety contact/sensor reset. A similar circuit is described in EP-A1-1864935 but instead of signaling an emergency stop through the control, a drive relay and a brake relay are connected in series to the safety chain so that if one of the safety contacts opens the drive relay and brake relay immediately open to de-energize the drive and release the brake, respectively.

Traditionally, steel cables have been used as traction means. More recently, synthetic cables and belt-like traction means comprising steel or aramid cords of relatively small diameter coated in a synthetic material have been developed. An important aspect of these synthetic traction means is the significant increase in the coefficient of friction they exhibit through engagement with the traction sheave as compared to the traditional steel cables. Due to this increase in relative coefficient of friction, when the brake is applied in an emergency stop for an elevator employing synthetic traction means there is a significant increase in the deceleration of the car, which severely degrades passenger comfort and could even result in injury to passengers.

SUMMARY

At least some disclosed embodiments provide an elevator safety circuit, which can be used to decelerate an elevator car during an emergency stop in a more controlled manner. In particular embodiments, an elevator safety circuit comprises a series chain of safety contacts having an input connected to a power source and a first safety relay deriving electrical power from an output of the series chain of safety contacts. A delay circuit is arranged between the output of the series chain of safety contacts and the first safety relay, Hence, if any of the safety contacts open to initiate an emergency stop, any process controlled by the operation of the first safety relay can be delayed.

The delay circuit may comprise a diode and a resistor arranged between the output of the series chain of safety contacts and the first safety relay and can further comprise a capacitor in parallel across the resistor and the first safety relay. Accordingly, the amount of delay can be set by selecting an appropriate R-C constant for the delay circuit.

Possibly, the elevator safety circuit further comprises a watchdog timer arranged to selectively bypass the first safety relay. Consequently, the first safety relay can be operated immediately and independently by the watchdog timer without a break in the series chain of safety contacts. The watchdog timer can be arranged in parallel with the first safety relay. Alternatively, the watchdog timer may be arranged in parallel with the capacitor.

The elevator safety circuit can further comprise a second safety relay arranged in parallel with the delay circuit and the first safety relay. Hence, if any of the safety contacts open to initiate an emergency stop, any process controlled by the operation of the second safety relay is immediate.

Alternatively, the second safety relay may be arranged between the output of the series chain of safety contacts and the delay circuit. With this series arrangement, a second diode can be arranged between the output terminal of the series chain of safety contacts and the watchdog timer to help ensure that both the first and the second safety relays can be operated immediately by the watchdog timer.

The delay circuit and the first safety relay may be integrated together as a time-delay relay. The time-delay relay can be a normally-open, timed-open relay or a normally-closed, timed-open relay.

Possibly, the first safety relay is a brake contact such that if an emergency stop is initiated, the brake is not applied immediately but after a delay. If the brake contact is a time-delay relay, then a second watchdog timer can be arranged in the brake circuit to selectively bypass the coils of the brakes.

Possibly, the second safety relay is a drive relay such that if an emergency stop is initiated, the drive relay immediately informs the elevator drive to either actively control the motor to decelerate the elevator or de-energize the motor.

Further embodiments provide a method for controlling the motion of an elevator comprising the steps of detecting whether a safety contact opens and operating a first safety relay a predetermined time interval after the opening of the safety contact.

In some embodiments, the method further comprises the steps of monitoring a drive of the elevator and operating the first safety relay when the drive experiences a software problem, a hardware problem or if the power supply to the drive is outside of permitted tolerances. Accordingly, the first safety relay can be operated independently of the safety contacts.

BRIEF DESCRIPTION OF THE DRAWINGS

The disclosed technologies are described by way of examples with reference to the accompanying drawings of which.

DETAILED DESCRIPTION

Figure 1:
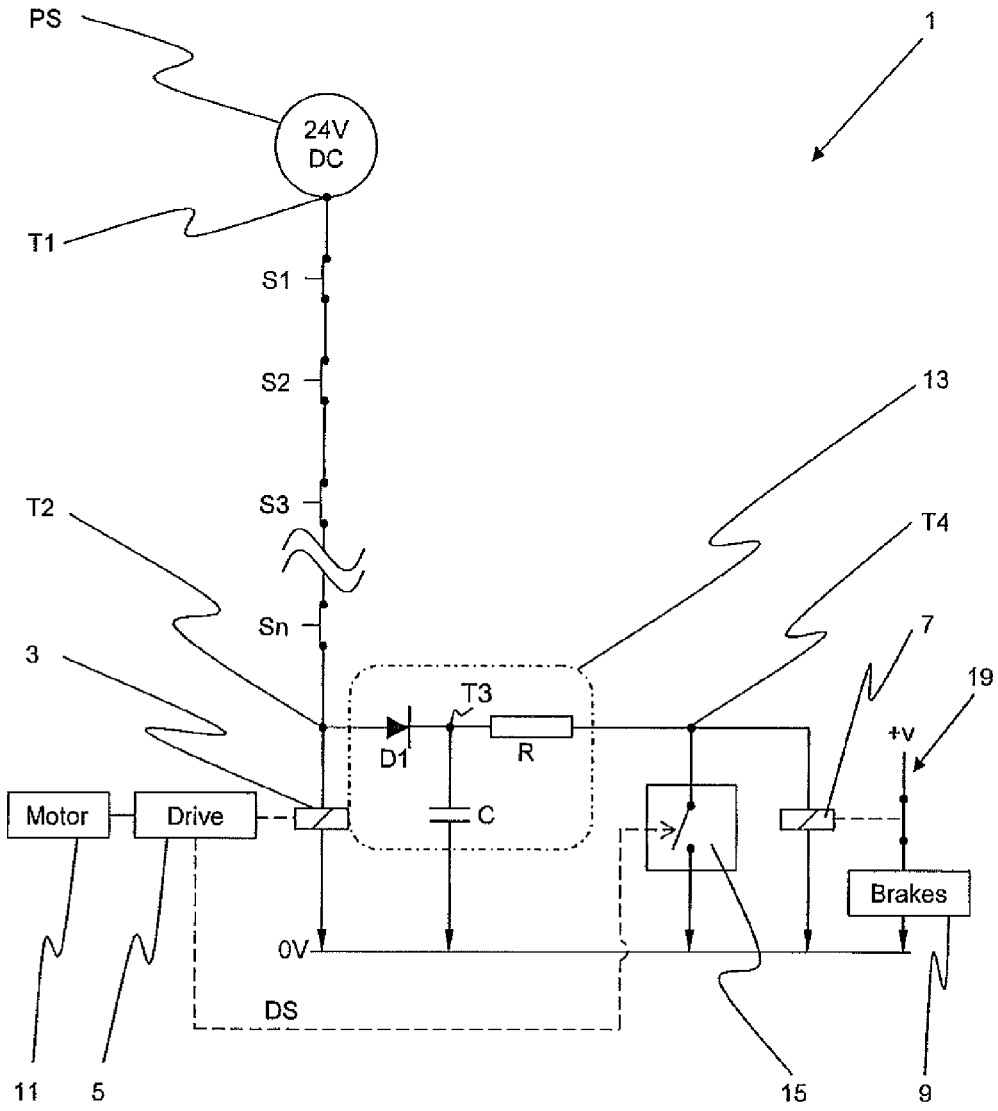
FIG. 1 is a schematic of an elevator safety circuit according to a first embodiment of the disclosed technologies.

A first elevator safety circuit 1 according to an exemplary embodiment is shown in FIG. 1 wherein an electrical power supply PS is connected to an input terminal T1 of a series chain of safety contacts S1-Sn. The contacts S1-Sn monitor various conditions of the elevator and remain closed in normal operation. For example, contact S1 could be a landing door contact which will remain closed so long as that particular landing door is closed. If the landing door is opened without the concurrent attendance of the elevator car at that particular landing, indicating a possibly hazardous condition, the contact S1 will open and thereby break the safety chain 1 initiating an emergency stop which will be discussed in more detail below.

A drive relay 3 is connected between the output terminal T2 of the series chain of safety contacts S1-Sn and a common reference point 0V. The common reference point is hereinafter referred to a ground and is considered to have zero voltage.

Power is also supplied by the output terminal T2 through a delay circuit 13 to a brake contactor 7. The delay circuit 13 comprises a diode D1, a resistor R and a capacitor C. The diode D1 and the resistor R are arranged in series between the output terminal T2 and an input terminal T4 to the brake contactor 7 whereby the diode D1 is biased to permit current flow in that particular direction and the capacitor C is arranged between ground 0V and the junction T3 of the first diode D1 and the resistor R.

Accordingly, in normal operation, with all safety contacts S1-Sn closed on the series chain, current flows from the power supply PS through the series chain S1-Sn and through the respective coils of the drive relay 3 and the brake contactor 7 maintaining both in their closed positions. Furthermore, the current flow will also charge the capacitor C of the delay circuit 13. With the drive relay 3 in its closed position the elevator drive 5 continues to control the motor 11 to raise and lower an elevator car in accordance with passenger requests received by the elevator controller. Similarly, with the brake contactor 7 closed, current flows through the brake circuit 19 to electromagnetically hold the elevator brakes 9 open against the biasing force of conventional brake springs.

If, however, an emergency situation is detected and one of the safety contacts S1-Sn opens, the circuit 1 is interrupted and current no longer flows through the coil of drive relay 3. Accordingly, the drive relay 3 immediately opens signaling to the drive 7 that an emergency stop is required whereupon the drive 7 actively controls the motor 11 to immediately decelerate the elevator. Alternatively, the drive relay 3 can be arranged to de-energize the motor 11.

Meanwhile, although no current flows through the diode D1, the charged capacitor C of the delay circuit 13 will discharge through the resistor R to maintain current flow through the coil of the brake contactor 7. Accordingly, the brake contactor 7 will continue to close the brake circuit 19 and the brakes 9 will remain open or de-active until the capacitor C has discharged sufficiently. Hence, although the safety circuit 1 has been interrupted, the brakes 9 will not be applied immediately but will instead be delayed for a certain time period determined by the R-C constant employed in the delay circuit 13. Hence, at least some embodiments provide a two phase emergency stop sequence comprising a first phase wherein the drive 5 immediately controls the motor 11 to decelerate the elevator in a controlled manner and a subsequent second phase wherein the brakes 9 are applied.

Figure 2:
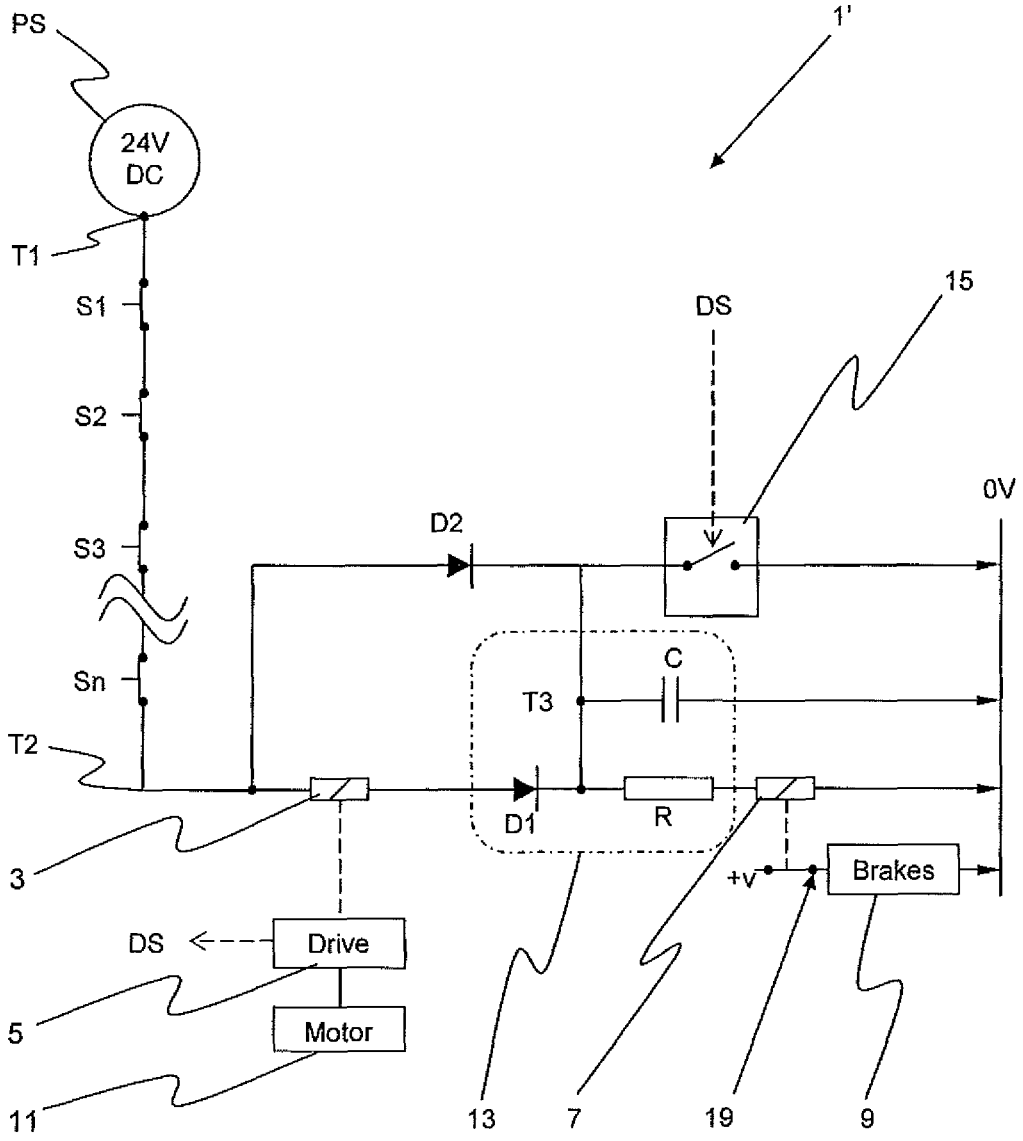
FIG. 2 is a schematic of an elevator safety circuit according to a second embodiment of the disclosed technologies.
Figure 3:
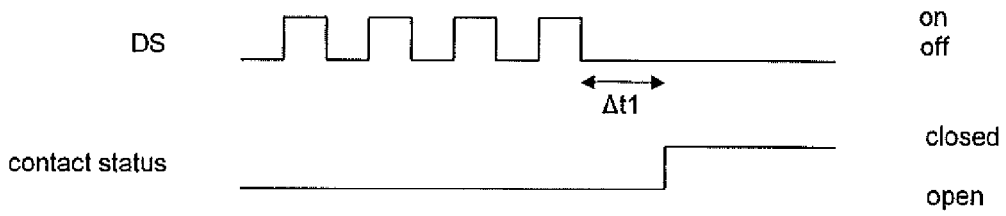
FIG. 3 depicts graphical representations of the control signal to, and the associated response of, the watchdog relay employed in the circuits shown in FIGS. 1 and 2.

The elevator safety circuit 1 also contains a watchdog timer 15 connected in parallel across the brake contactor 7 i.e. between the terminal 14 and ground 0V. Alternatively, the watchdog timer 15 could be connected in parallel across the capacitor C of the delay circuit 13 as illustrated in the embodiment of FIG. 2. The watchdog timer 15 receives a signal DS from the drive 5. Under normal operating conditions, this signal DS is continuously sequenced on and off as depicted in FIG. 3 and the watchdog timer 15 remains open. If the drive 5 experiences a software or hardware problem or if the power supply to the drive 5 is outside of permitted tolerances, as in the case of a power disruption, the signal DS from the drive 5 stops cycling and after a short time period $\Delta t1$ the watchdog timer 15 times out and closes. Should this happen, the safety circuit 1 discharges through the watchdog timer 15 so that the drive relay 3 and the brake contactor 7 immediately open as in the prior art.

An alternative elevator safety circuit 1' according to a further embodiment is illustrated in FIG. 2. The circuit 1' essentially contains the same components as in the previous embodiment but in this case the drive relay 3 and the brake contactor 7 are arranged in series between the output terminal T2 of the series chain of safety contacts S1-Sn and ground 0V. Again, the circuit 1' provides a two phase emergency stop sequence comprising a first phase wherein the drive 5 immediately controls the motor 11 to decelerate the elevator in a controlled manner and a subsequent second phase wherein the brakes 9 are applied.

In the present embodiment, it is not sufficient for the watchdog timer 15 to bypass just the brake contactor 7 as in the previous embodiment, since power would still flow through the drive relay 3 if there is a malfunction with the drive 5. Instead, a second diode D2 is inserted between the output terminal T2 and the watchdog timer 15 to drain the circuit 1' and ensure that both the drive relay 3 and the brake contact 7 are opened immediately if there is a drive fault.

Figure 5:
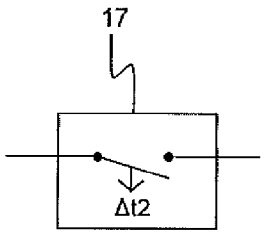
FIG. 5 illustrates a typical time-delay relay for use in the circuit of FIG. 4.
Figure 4:
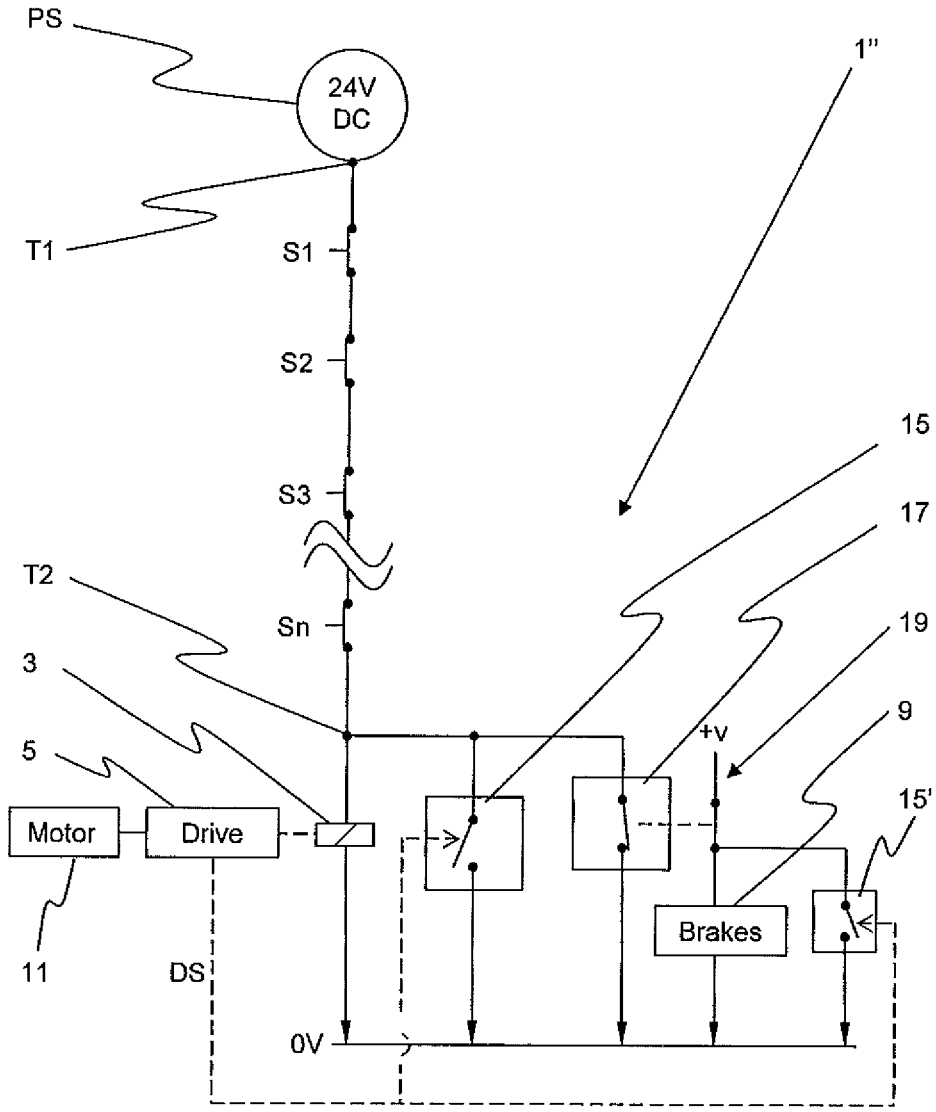
FIG. 4 is a schematic of an elevator safety circuit according to a third embodiment of the disclosed technologies.

A further embodiment is shown on FIG. 4. In this circuit 1" the delay circuit 13 and brake contactor 7 of FIG. 1 are replaced by a time-delay relay 17. In the present example the relay 17 is a normally-open, timed-open relay NOTO as depicted in FIG. 5 having the switching characteristics illustrated in FIG. 6.

In normal operation, with all safety contacts S1-Sn closed on the series chain, current flows from the power supply PS through the series chain S1-Sn and through the respective coils of the drive relay 3 and the time-delay relay 17 maintaining both in their closed positions. With the time-delay relay 17 closed, current flows through the brake circuit 19 to electromagnetically hold the elevator brakes 9 open against the biasing force of conventional brake springs.

Figure 6:
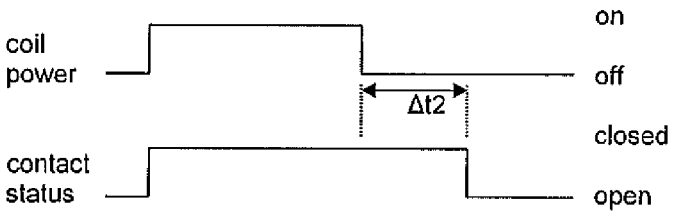
FIG. 6 depicts graphical representations of the coil power to, and the associated response of, the time-delay relay of FIG. 5.

If an emergency situation is detected and one of the safety contacts S1-Sn opens, the circuit 1" is interrupted and current no longer flows through the coils of drive relay 3 or the time-delay relay 17. Accordingly, the drive relay 3 immediately opens signaling to the drive 7 that an emergency stop is required whereupon the drive 7 actively controls the motor 11 to immediately decelerate the elevator. On the other hand, as illustrated in FIG. 6 the time-delay relay 17 remains closed for a predetermined time period $\Delta t2$ after its coil has been de-energized and accordingly the time-delay relay 17 will continue to close the brake circuit and the brakes 9 will remain open or de-active during the predetermined time period Δt2. Hence, although the circuit 1" has been interrupted, the brakes 9 will not be applied immediately but will instead be delayed for a certain time period Δt2. Again, this embodiment provides a two phase emergency stop sequence comprising a first phase wherein the drive 5 immediately controls the motor 11 to decelerate the elevator in a controlled manner and a subsequent second phase wherein the brakes 9 are applied.

As in this first embodiment shown in FIG. 1, the elevator safety circuit 1''' contains a first watchdog timer 15 connected in parallel across the time-delay relay 17. As previously described, the first watchdog timer 15 receives a signal DS from the drive 5. Under normal operating conditions, this signal DS is continuously sequenced on and off as depicted in FIG. 3 and the first watchdog timer 15 remains open. If the drive 5 experiences a software or hardware problem or if the power supply to the drive 5 is outside of permitted tolerances, as in the case of a power disruption, the signal DS from the drive 5 stops cycling and after a short time period Δt1 the first watchdog timer 15 times out and closes. Should this happen, the safety circuit 1''' discharges through the first watchdog timer 15 so that the drive relay 3 immediately opens. However, in this embodiment, even though the safety circuit 1''' discharges through the first watchdog timer 15, by its very nature, the time-delay relay 17 will not open immediately but will instead be delayed for a certain time period Δt2. To overcome this problem, a second watchdog timer 15' can be installed in the brake circuit 19 to permit current to bypass the coils of the brakes 9 if the signal DS from the drive 5 stops cycling. Accordingly, both the drive 5 and the brakes 9 are notified simultaneously if there is a drive fault by the first and the second watchdog timers, respectively.

Figure 7:
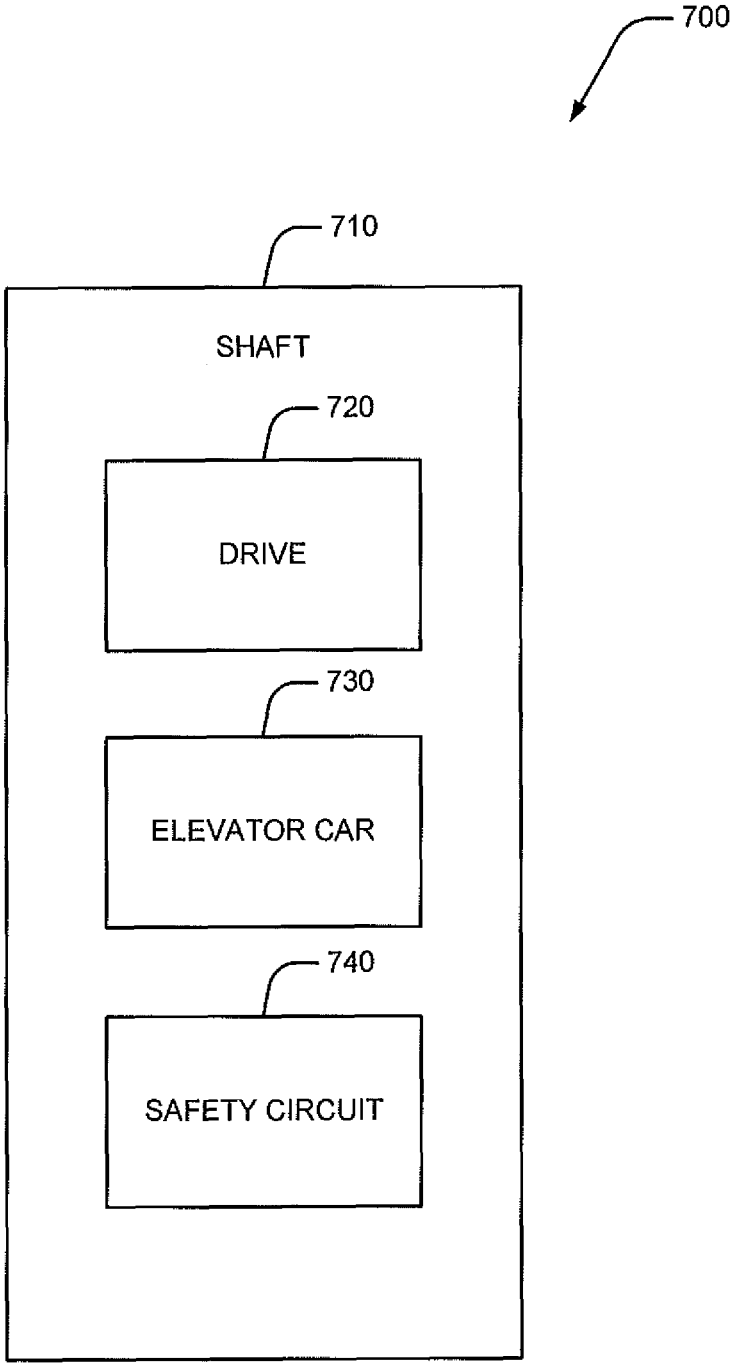
FIG. 7 depicts a block diagram of select portions of an exemplary embodiment of an elevator installation.

FIG. 7 depicts a block diagram of select portions of an exemplary embodiment of an elevator installation 700. The installation 700 comprises an elevator car 730 disposed in an elevator shaft 710. The installation 700 further comprises an elevator drive 720 and a safety circuit 740. The safety circuit 740 can comprise any of the safety circuit embodiments disclosed herein.

Although at least some embodiments can, in particular, be used with synthetic traction means, further embodiments can equally be applied to any elevator to reduce the deceleration of an elevator car during an emergency stop and thereby improve passenger comfort.

Having illustrated and described the principles of the disclosed technologies, it will be apparent to those skilled in the art that the disclosed embodiments can be modified in arrangement and detail without departing from such principles. For example, instead of mounting the brake sets 12,14 within the drive unit as depicted in FIG. 1, they could be mounted on the car so as to frictionally engage the guide rails to bring the car to a halt. Furthermore, although the two safety relays have been specifically described as being operative with respect to the brake and the drive, they can also be used to control other functions within the elevator. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator safety circuit comprising:

a series chain of safety contacts comprising a power source input;

a first safety relay configured to be energized by electrical power from an output of the series chain of safety contacts;

a delay circuit arranged between the output of the series chain of safety contacts and the first safety relay for continued energizing of the first safety relay for a predetermined time interval after opening of any one of the safety contacts; and a watchdog timer arranged to selectively bypass and de-energize the first safety relay.

2. An elevator safety circuit according to claim 1, the delay circuit comprising:

a diode and a resistor arranged in series between the output of the series chain of safety contacts and the first safety relay; and a capacitor in parallel across the resistor and the first safety relay.

3. An elevator safety circuit according to claim 2, the watchdog timer being arranged in parallel with the capacitor.

4. An elevator safety circuit according to claim 1, the watchdog timer being arranged in parallel with the first safety relay.

5. An elevator safety circuit according to claim 1, further comprising a second safety relay arranged between the output of the series chain of safety contacts and the delay circuit and configured to be energized by the electrical power from the output of the series chain of safety contacts.

6. An elevator safety circuit according to claim 5, further comprising a diode arranged between the output terminal of the series chain of safety contacts and the watchdog timer.

7. An elevator safety circuit according claim 1, the delay circuit and the first safety relay being integrated together as a time-delay relay.

8. An elevator safety circuit according to claim 7, the time-delay relay being a normally-open, timed-open relay.

9. An elevator safety circuit according to claim 7, the time-delay relay being a normally-closed, timed-open relay.

10. An elevator safety circuit comprising:

a series chain of safety contacts comprising a power source input;

a first safety relay configured to be energized by electrical power from an output of the series chain of safety contacts;

a delay circuit arranged between the output of the series chain of safety contacts and the first safety relay for continued energizing of the first safety relay for a predetermined time interval after opening of any one of the safety contacts; and a second safety relay arranged in parallel with the delay circuit and the first safety relay and configured to be energized by the electrical power from the output of the series chain of safety contacts.

11. An elevator safety circuit according to claim 10, the delay circuit and the first safety relay being integrated together as a time-delay relay.

12. An elevator safety circuit according to claim 11, the time-delay relay being a normally-open, timed-open relay.

13. An elevator safety circuit according to claim 11, the time-delay relay being a normally-closed, timed-open relay.

14. A method for controlling an elevator, the method comprising:

detecting an opening of a safety contact;

operating a first safety relay a predetermined time interval after the opening of the safety contact;

monitoring a drive of the elevator; and operating the first safety relay when the drive experiences a software problem, a hardware problem or if the power supply to the drive is outside of a permitted tolerance.

15. An elevator installation, comprising:

an elevator car disposed in a shaft; and an elevator safety circuit, the elevator safety circuit comprising, a series chain of safety contacts comprising a power source input, a first safety relay configured to be energized by electrical power from an output of the series chain of safety contacts, a delay circuit arranged between the output of the series chain of safety contacts and the first safety relay for continued energizing of the first safety relay for a predetermined time interval after opening of any one of the safety contacts, and a watchdog timer arranged to selectively bypass and de-energize the first safety relay.

16. An elevator installation, comprising:

an elevator car disposed in a shaft; and an elevator safety circuit, the elevator safety circuit comprising, a series chain of safety contacts comprising a power source input, a first safety relay configured to be energized by electrical power from an output of the series chain of safety contacts, a delay circuit arranged between the output of the series chain of safety contacts and the first safety relay for continued energizing of the first safety relay for a predetermined time interval after opening of any one of the safety contacts, and a second safety relay arranged in parallel with the delay circuit and the first safety relay and configured to be energized by the electrical power from the output of the series chain of safety contacts.

* * * * *